US006526716B2

(12) United States Patent
Paul

(10) Patent No.: US 6,526,716 B2
(45) Date of Patent: Mar. 4, 2003

(54) SUSPENDED CEILING GRID STRUCTURE WITH MAIN RUNNERS INCORPORATING MEASUREMENT INDICIA FOR ESTABLISHING A BORDER DIMENSION FOR A ENGAGEMENT BY A CROSS TEE

(76) Inventor: William Paul, 511 River Rouge Dr., Waterford, MI (US) 48327

( * ) Notice: Subject to any disclaimer, the term of this patent is extended or adjusted under 35 U.S.C. 154(b) by 0 days.

(21) Appl. No.: 09/850,310

(22) Filed: May 7, 2001

(65) Prior Publication Data

US 2002/0083669 A1 Jul. 4, 2002

Related U.S. Application Data

(63) Continuation-in-part of application No. 09/753,508, filed on Jan. 3, 2001.

(51) Int. Cl.[7] ..... E04B 9/00

(52) U.S. Cl. ..... 52/506.06; 52/506.07; 52/105

(58) Field of Search ..... 52/506.06, 506.07, 52/105

(56) References Cited

U.S. PATENT DOCUMENTS

| | | | | | |
|---|---|---|---|---|---|
| 3,374,596 | A | * | 3/1968 | O'Brien et al. | 52/105 X |
| 3,979,874 | A | | 9/1976 | Cubbler, Jr. et al. | |
| 4,161,856 | A | | 7/1979 | Brown et al. | |
| 4,406,104 | A | | 9/1983 | Beck et al. | |
| 4,470,239 | A | | 9/1984 | Sauer | |
| 4,505,083 | A | | 3/1985 | Mieyal | |
| 4,525,973 | A | | 7/1985 | Vukmanic et al. | |
| 4,573,302 | A | * | 3/1986 | Caretto | 52/105 X |
| 4,677,802 | A | | 7/1987 | Vukmanic | |
| 4,712,350 | A | | 12/1987 | Vukmanic | |
| 4,727,703 | A | | 3/1988 | Platt | |
| 4,923,032 | A | | 5/1990 | Nuernberger | |
| 4,927,696 | A | * | 5/1990 | Berg | 52/105 X |
| 5,044,138 | A | | 9/1991 | Zaccardeli et al. | |
| 5,216,865 | A | | 6/1993 | Lalonde et al. | |
| 5,666,778 | A | * | 9/1997 | Grattan et al. | 52/606 |
| 5,687,525 | A | * | 11/1997 | Koski et al. | 52/506.07 |
| 5,839,246 | A | | 11/1998 | Ziegler et al. | |
| 5,950,319 | A | * | 9/1999 | Harris | 52/105 X |
| 5,966,887 | A | | 10/1999 | Mieyal | |
| 5,970,672 | A | * | 10/1999 | Robinson | 52/270 |
| 6,047,511 | A | | 4/2000 | Lehane et al. | |
| 6,230,464 | B1 | * | 5/2001 | Vrame | 52/506.08 |
| 6,269,595 | B1 | * | 8/2001 | Blubaugh et al. | 52/105 |

* cited by examiner

*Primary Examiner*—Carl D. Friedman
*Assistant Examiner*—Brian E. Glessner
(74) *Attorney, Agent, or Firm*—Gifford, Krass, Groh, Sprinkle, Anderson & Citkowski, P.C.

(57) ABSTRACT

A measurement indicia scheme applied to a main runner of a suspended grid structure to establish a correct border distance of the main runner and between an associated wall angle and interconnecting cross runners. The main runner defines, in cross section, a tile support lip, a web extending from the support lip, and a plurality of elongated channels being formed through first and second opposite faces of the web at axially spaced apart intervals and between a first end and a second end. The measurement indicia scheme is applied to the main runner and extends from at least one of the first and second ends of the runner. The indicia scheme coincides with the placement and location of at least a first of the elongated channels positioned relative the selected and main runner end. The indicia scheme further establishes a defined distance from a second and succeeding elongated channel positioned along the main runner. The first and second elongated channels correspond, respectively, to primary and secondary reference points proximate the extending end of the runner, the measurement scheme being employed, upon selection of one of the primary and secondary reference points, to establish a correct border distance of the main runner for sectioning and prior to location of the cross runners and engagement of the connector clips, associated with the cross runners, within the main runner channels.

19 Claims, 2 Drawing Sheets

SUSPENDED CEILING GRID STRUCTURE WITH MAIN RUNNERS INCORPORATING MEASUREMENT INDICIA FOR ESTABLISHING A BORDER DIMENSION FOR A ENGAGEMENT BY A CROSS TEE

CROSS REFERENCE TO RELATED APPLICATIONS

The present application is a continuation-in-part of U.S. application Ser. No. 09/753,508, filed Jan. 3, 2001, and entitled "Suspended Ceiling Grid Structure with Main Runners Incorporating Coded Matching Indicia for Receiving Cross Runners in Desired Spaced Apart Fashion".

BACKGROUND OF THE INVENTION

1. Field of the Invention

The present invention relates generally to suspended ceiling grid structures and, more particularly, to a grid structure with main runners incorporating an extending and measurement indicia scheme along a predetermined border portion of the main runner, and at either or both opposite ends thereof. The measurement indicia scheme of the present invention provides the grid structure installer with the capability to very quickly establish a previously determined and correct border dimension for the subsequent installation of an engaging cross runner, and such as is desired to provide consistent and equal borders along opposite extending ends of the room enclosure within which the grid structure is installed.

2. Description of the Prior Art

Suspended structures for creating ceiling grids are fairly well known in the art, the concept behind such structures being to provide suspended support for ceiling tiles. The tiles are typically rectangular shaped and acoustically insulating in nature and function to recreate a uniform and "dropped" ceiling appearance to an interior enclosure with an unfinished ceiling, such enclosures including commercial building interiors, as well as basement ceilings in residential dwellings.

U.S. Pat. No. 4,677,802, issued to Vukmanic, discloses one known arrangement of suspended ceiling system and runner and which is characterized by each of the runners being composed of a first member and a cap member. The first member is bent to form an inverted T-bar configuration with a groove extending inwardly from the flange of the T and the cap member having the same configuration and being secured on the flange of the T-bar configuration to form a channel with flange portions on each side for supporting panels of the ceiling system.

U.S. Pat. No. 4,712,350, also issued to Vukmanic, discloses a centering arrangement for T members of a suspended ceiling for holding a plurality of panels supported by the runners in a desired position on the flanges of the runners. The centering arrangement includes a bump extending from each side of a cross sectional web profile of the runner, the bump being formed in the web immediately adjacent a cut in the runner so that the drawing of the material into the bump will not draw material from the flange or adjacent thereto. The bump shape is preferably "half-moon" or semi-circular in configuration and so that it provides a smooth camming surface for both lateral movement of the panel along the flange as well as vertical movement towards the flange.

U.S. Pat. No. 4,525,973, again issued to Vukmanic, teaches a suspended ceiling system again teaching main runners and cross runners which are inter-engageable to define a rectangular grid system. Suitably configured and elongated apertures are formed in the webbed profile of the main runners in axially spaced apart fashion and which receive an appropriately configured connecting end of selected cross runners and so that the cross runners are engaged to the main runner in mutually engaging fashion and on opposite sides thereof. Additional examples of suspended ceiling grid systems are illustrated by the likes of U.S. Pat. No. 4,470,239, issued to Sauer, U.S. Pat. No. 4,727,703, issued to Platt, and U.S. Pat. No. 5,839,246, issued to Ziegler.

SUMMARY OF THE PRESENT INVENTION

The present invention discloses a grid structure with main runners incorporating an extending and measurement indicia scheme, along predetermined border portions thereof. As previously explained, the measurement indicia scheme of the present invention provides the grid structure installer with the capability to very quickly establish a previously determined and correct border dimension for the subsequent installation of an engaging cross runner, and such as is desired to provide consistent and equal borders along opposite extending ends of the room enclosure within which the grid structure is installed.

An extending end portion of a main grid runner is illustrated, the main runners typically measuring an overall twelve (12') feet in length according to industry standard. The main runner again includes such general structural features, when illustrated in cross section, as a tile support lip, a web extending from a midpoint of the lip and defining first and second opposite faces, a thickened upper edge, and a connector clip.

The main runner also includes a plurality of individual and elongated channels formed through its faces and at axially spaced apart intervals. The channels are each configured for receiving, in interconnecting fashion, a connector clip associated with an extending end of a cross tee. The main runners further include such channels configured at a dimension of 3" from a given end and opposite end location (exclusive of the connector clip) and at further equal six (6") inch intervals extending therebetween and across the entire intermediate length of the main runner.

The interconnection scheme of the spaced and parallel extending main tees, along with the cross wise extending tees, defines the interconnecting grid structure for subsequent installation of ceiling tiles. According to the conventional art, two (2') and four (4') foot spaced cross tees (and corresponding 2'×2' or 2'×4' tiles) are employed in assembling and completing the grid structure.

As is also known in the relevant art, room measurements rarely, if ever, even out to provide equidistant dimensions established between opposite and parallel extending border locations of the grid structure. Typically, the installer is then required to undertake additional measurement and sectioning of the main runners (through the use of a tape measure typically) to achieve the desired and equidistant dimensions and before installing the main runners. It is also conventionally known that an equidistant distance to be achieved for each of two opposite border locations will either fall into a dimension of less than 48" (four feet) or 24" (two feet), based again on whether 2'×2' or 2'×4' tiles are to be utilized. The main runner indicia scheme provides the installer, once he or she has previously determined the overall required length of the room enclosure and the required dimension for establishing the equidistant and opposite extend borders, with the ability to immediately proceed with sectioning an exact portion from the end of the main runner, utilizing the imprinted indicia scheme.

The indicia scheme includes a plurality of half inch incremental markings extending from the end of the main runner to a location six inches inwardly. The first three (3") elongated channel is located, naturally, at the midpoint of the six (6") inch indicia scheme and is considered to function as a primary reference point for determining a desired sectioning distance. The next succeeding and elongated channel is located in actuality a distance of nine (9") inches from the end location of the main runner, however it is, for present purposes, considered only to be a secondary reference point of an additional six (6") beyond the primary reference point.

As is again known, all succeeding and intermediate extending channels are at identical and six (6") increments, such that a desired subset group of these elongated channels iterate (in inches) as follows: 3; 6; 12; 18; 24; 30; 36; 42 and 48. For purposes of measuring and establishing the equidistant border layout, reference is not necessarily made to the six inch markers beyond 48" (such as at 54", 60", . . . ) since this range will fall into areas designated for placement of full sized tiles.

The present invention further takes advantage of the fact that only plus or minus variations of six inch increments need to be considered when determining where to section the main runner for equidistant placement of the border extending cross runners, these again being accounted for by the primary reference point, the next succeeding six inch spaced secondary reference point, and the 0–6" measurement indicia scheme. By example, the desire to establish a thirteen (13") inch border at each end of the assembled main runner(s) requires only the installer to proceed to the primary reference point (considered to equate to 6", 12", 18", etc., distances), beyond which the installer counts out an additional one (1") inch towards the exposed end of the main tee.

In a further example, by which the installer desires to establish seventeen (17") inch and equidistant borders, the installer will then desirously select the secondary reference point (rather than the primary reference) due to the fact that an additional five (5") inches (beyond the selected six inch increment to which each of the primary and secondary reference points equate, and in this case being twelve (12") inches) is required and further due to the fact that only three (3") inches exist beyond the primary reference point and the exposed end of the main runner. To quickly complete the measurement, and subsequent sectioning act, the installer designates the second reference point as equating twelve (12") inches, then adds five (5") additional inches in a direction towards the primary reference point, this further immediately resulting in the installer jumping to the primary reference point and counting back one (1") inch towards the secondary reference point, at which point the runner is sectioned and the resulting and overall running length of the main runner, or plurality of interconnected runners, is such that an equidistant 17" is provided at each opposite end of the assembled main tee.

The border measurement and indicia scheme of the invention may also advantageously utilize the marking system incorporated into the main runners for the identification and proper location of the cross runners prior to engagement of the connector clips within the main runner channels. Specifically, the color coding variation of the underlying marking system can be utilized by the installer in quickly establishing reference points (typically within the 24" or 48" ranges of each opposite main tee end) and for counting back to the primary and/or secondary reference points and border indicia scheme.

A further feature of the present invention is the provision of a diagonal ruler marking at a selected distance along the main runner. The purpose of the selected marking is to provide a standard for measuring both diagonal distances of a standard 2'×4' grid and to ensure the establishment of a perfectly configured rectangle.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
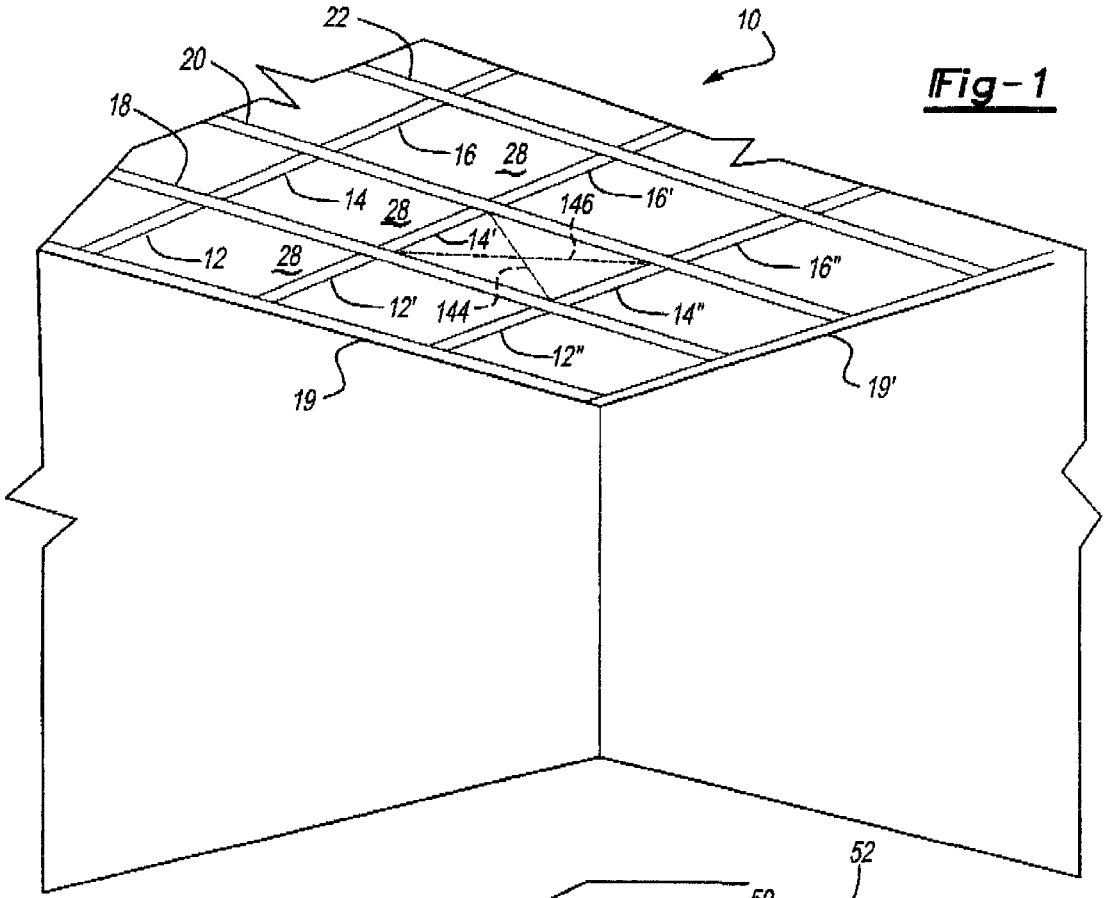
FIG. 1 is an environmental view illustrating a drop ceiling grid structure, and such as is provided by the marking system forming a portion of the present invention.

Referring now to FIG. 1, a general illustration of a drop ceiling grid structure is illustrated at 10 and which includes pluralities of cross runners 12, 12', 12", et. seq., 14, 14', 14", et. seq., 16, 16' and 16", et. seq., engaged in interconnecting fashion with parallel spaced apart main runners 18, 20, 22, et. seq. Wall angles 19 and 19' are also illustrated, in extending and interconnected fashion around a portion of a border defining the room enclosure. In particular, wall angle 19' defines a border from which perpendicularly extend the main runners 18, 20, 22, et. seq., and to which it is desirous to establish a desired border (such as equidistant with an opposite end border not shown in FIG. 1) and in the location range between the wall angle 19' and the placement of cross tees 12", 14", 16" et. seq.

Figure 2:
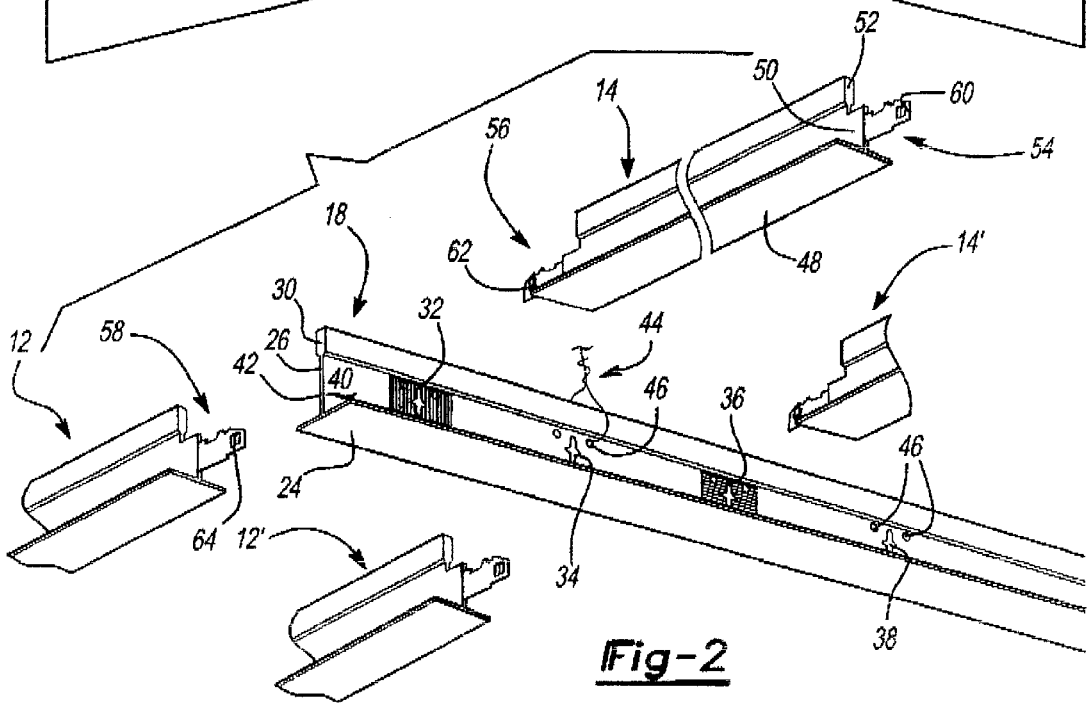
FIG. 2 is an exploded view in section of a main runner and opposing pairs of engageable cross runners according to the marking system.

Referring now to FIG. 2, a partial view is illustrated of selected main runner 18 illustrated in exploded fashion with corresponding and cross wise extending runners 12 and 12' & 14 and 14'. While only a portion of the overall grid structure is illustrated, it is also understood that each and every of the spaced apart and parallel extending main runners and interengaging cross runners are constructed in substantially identical fashion. Accordingly, a repetitive description of each and every main runner and cross runner is not necessary for purposes of this description.

The main runner 18 is constructed as an elongate extending member and includes, in cross section, a tile support lip 24 and a web 26 extending from a substantial midpoint of the lip 24. The lip 24, as is well understood and which can also be viewed from FIG. 1, provides a ledge support surface to the extending edges of ceiling tiles, and which are representatively illustrated at 28 in FIG. 1. Referring again to FIG. 2, the web 26 of the main runner 18 extends substantially upwardly from the tile support lip 24 and terminates in a thickened upper edge 30. The main and cross runners are both preferably constructed from planar shaped blanks of aluminum or like material and it is understood that the thickened upper edges (again shown at 30) may be provided by an extending portion of that blank which is folded over. It is further desirous to strengthen the main runner 18 from both cantilever and torsional forces over an axial direction, and this is provided in large part by the cross sectional configuration of the web 26 with enlarged upper edge 30.

A plurality of elongated channels 32, 34, 36, 38, et. seq., are formed through first and second opposite faces 40 and 42 of the main runner 18 (see again FIG. 2) and at axially spaced apart intervals between first and second ends of the selected runner 18. The particular configuration of the channels 32, 34, 36, 38, et., seq., is within the discretion of the individual skilled in the art, however it is contemplated that the channels will each include a substantially enlarged or diamond-shaped configuration as is clearly illustrated. The purpose of the channel configurations, as previously discussed, is to facilitate insertion and engagement of the cross runners with the selected main runner. It is further understood that the first elongated channel 32 is placed at three (3") from the exposed end of the main tee, with the succeeding elongated channels 34, 36, 38, et. seq., being located at additional and identical six (6") increments.

The main runner 18 is suspended from a ceiling (not shown) of the interior enclosure by hanger wires, see by example at 44, which extend through a selected one 46 of a plurality of apertures formed through the web 26 of the main runner 18 and at spaced apart intervals along its axially extending length. Referring again to FIG. 2, the apertures are typically formed in pairs 46 in spaced fashion and corresponding to the arrangement of the channels 32, 34, 36, 38, et. seq., along the main runner. It is further contemplated that other structures can be employed for suspending the runners from the ceiling and without departing from the scope of the invention.

Referring again to FIG. 2, the selected pluralities 12, 12' and 14, 14' of cross runners are illustrated, in reduced length for ease of presentation, and which interengage within selected apertures of the corresponding main runner 18. For purposes of ease in explanation, the cross runners are all identically constructed in cross section. Accordingly, and for explanatory purposes, the description shall be limited to selected cross member 14, which is illustrated in reduced length fashion.

Referring again to FIG. 2, cross member 14 includes a tile support lip 48, similar in construction to the corresponding support lip 24 of the main runner 18, and so that, upon interengaging the cross runners with the main runner, creates a continuous and rectangular extending edge for supporting the edges of the ceiling tiles 28.

The cross members, again representatively illustrated by cross member 14, each include a web 50 extending upwardly from a substantial midpoint of the tile support lip 48 and terminating in an enlarged or thickened upper edge 52 provided for substantially the same purposes of the thickened upper edge 30 of the afore-described main runner 18, e.g., that being to counteract bending and torsional forces along an axially extending length of each of the cross runners.

First and second connector clips 54 and 56 extend from first and second associated ends of each of the cross runners (e.g., cross runner 14). The connector clips 54 and 56 are typically secured to the opposite ends of the runner 14 by conventional means, such as rivets, and are further configured so that a selected and elongated channel (e.g., channels 32 and 36) is engaged by a single connector clip from one side, and/or opposing connector clips (see again 56 for cross runner 14 and 56 for cross runner 12). It is also contemplated that additional connector clips (not shown) are secured to extending ends of the main runners 18, 20, 22, et. seq. and so that the grid structure can be secure against wall edge locations of the room enclosure.

In one preferred configuration, each of the connector clips 54, 56, 58, et. seq., includes an outwardly flared tab portion, reference being made to flared portions 60, 62, 64, et. seq., and corresponding to clips 54, 56, 58, et. seq., respectively. The provision of the outwardly flared tab portions causes the connector clips to abut against an associated side edge of each elongated channel and to thereby prevent inadvertent disengagement of the cross runner(s) from the interengaged main runner. Particular attention is drawn to the elongated channels 32 and 36, each of which exhibit the enlarged or diamond-shaped configurations which permit opposing connector clips of pairs of cross runners 12, 14 and 12', 14' to engage therethrough.

Figures 3, 4, 5, 6:
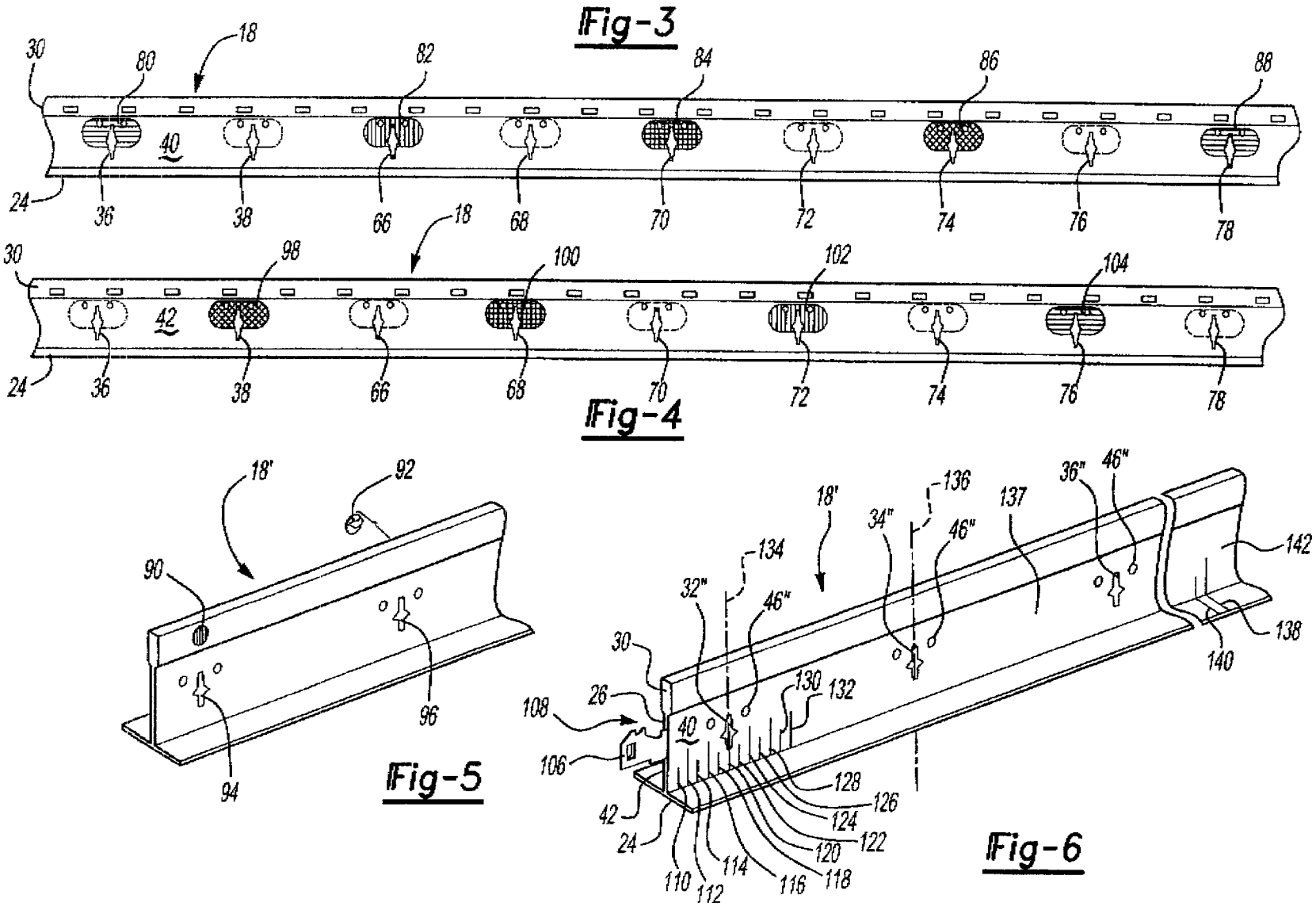
FIG. 3 is a plan view illustrating a first side of a selected main runner and exhibiting a first variation of marking indicia according to the present invention.
FIG. 4 is a plan view illustrating a second side of the selected main runner shown in FIG. 3 and exhibiting a second variation of marking indicia according to the present invention.
FIG. 5 is a sectional view of a second variation of the marking indicia and illustrating adhesively securable appliques according to the present invention.
FIG. 6 is a perspective end section of a selected main tee and illustrating the border measurement indicia scheme as well as the diagonal marking scheme according to the present invention.

Referring again to FIG. 2, as well as to FIGS. 3 and 4, the underlying marking indicia system of the main runners is again illustrated which is applied to selected channels of the main runners (again referenced by main runner 18) and which identifies proper location of the cross runners prior to engagement of the connector clips within said main runner channels. Specifically, and referencing FIG. 3, an illustration is shown of the first side 40 of the selected main runner 18 and which includes color coded channels according to a plurality of colored indicia. Specifically, channels 36 and 38 are represented and further channels 66, 68, 70, 72, 74, 76, 78, et. seq., are shown in progression.

Further illustrated are first 80, second 82, third 84 and fourth 86 selected color indicias and which correspond to selected and alternating channels 36, 66, 70 and 74. The indicia scheme presented typically repeats and a succeeding first color indicia is further shown at 88 for channel 78. The colors selected are within the discretion of one skilled in the art and one suggested applications contemplates blue 80, red 82, black 84 and white 86 (repeating again with blue 88 at channel 78). It is further contemplated that each color indicia is applied by a painting application. Referring further to FIG. 5, a modified main runner 18', an alternative scheme is shown in which each color indicia is provided in the form of an adhesive applique and which is illustrated by appliques 90 and 92 which are adhesively secured to apertures 94 and 96.

Referring again to FIG. 4, the reverse side 42 of the main runner 18 is illustrated and in which the color indicia has been offset, or shifted, relative to the channels. Specifically, white 98 coincides with channel 38, black 100 with channel 68, red 102 with channel 72 and, finally, blue 104 with channel 76. The purpose of the marking indicia provided upon both sides of the main runners in offsetting fashion is so that differing lineal standards may, at the election of the user, be employed on either side of the main runners and at the election of the user.

In any application, the marking indicia provides the user the ability to measure a correct lineal footage for spacing the engageable cross members. For example, cross members may be installed at every blue, red, black or white indicia marked channel. In the preferred example, the matching indicia are spaced at four foot increments to correspond with the sizing of the ceiling tiles and or light panels which are installed within the grid structure. The user may also choose to employ a different spacing standard on the reverse face of the main runner and which takes advantage of the offsetting pattern of the marking indicia. The offset arrangement of the marking schemes (comparing again the reverse sides of FIGS. 3 and 4) is also established so that the main runners may be reversible in use, thus increasing their applicability and greatly reducing the possibility of the installer committing an error when assembling the main tees.

Referring finally to FIG. 6, an extending end portion of a further modified main grid runner 18" is illustrated and by which is disclosed a measurement indicia scheme for instantaneously and effectively establishing specific, or equidistant, border locations between a given wall angle location (see again at 19') and the distance established by the spaced apart and parallel extending cross tees (again at 12", 14", 16", et. seq.). The main grid runner 18" is further illustrated in reduced length and includes an extension portion corresponding to placement of diagonal marking indicia, the purpose for which will be subsequently described.

As previously explained, the measurement indicia scheme of the present invention provides the grid structure installer with the capability to very quickly establish (practically instantaneously) a previously determined and correct border dimension for the subsequent installation of the engaging cross runners, and such as is desired to provide consistent and equal borders along opposite extending ends of the room enclosure within which the grid structure is installed.

Referring again to FIG. 6, only a sectioned end portion of the main runner 18" is illustrated, it again being understood that such main runners each typically measure an overall twelve (12') feet in length according to industry standard. The main runner again includes such general structural features, when illustrated in cross section, as the tile support lip 24, web 26 extending from a midpoint of the lip 24 and defining first 40 and second 42 opposite faces, and the thickened/enlarged upper edge 30. Also, a connector clip (illustrated in phantom at 106) may extend from an exposed end 108 of the main tee 18" in the manner known in the art.

The main runner 18" again includes the plurality of individual and elongated channels formed through its faces 40 and 42 and at axially spaced apart intervals. The channels, as previously described, are each configured in a given manner (and again including such as a diamond-shape) for receiving, in interconnecting fashion, the connector clip (such as at 64) associated with an extending end of a cross tee, such as again by example at 12.

In the manner as has been previously disclosed, the main runner 18" again includes an initial elongated channel 32" configured at a dimension of 3" from the end 108 illustrated, as well as from an opposite end location, not shown in FIG. 6 and exclusive of the extending distance of the connector clip 106. Additional elongated channels 34", 36", et. seq. further extend at equal six (6") inch intervals and across the entire intermediate length of the main runner, up to the final and reverse side elongate channel (again not shown) and which is again located at a three (3") distance from the opposite main tee end. Apertures 46" are again shown and are engaged by the hanger wires to permit the installer to suspend the main runner 18" after the measurement and sectioning steps have been completed.

As has again been previously described and illustrated in FIG. 1, the interconnection scheme of the spaced and parallel extending main tees, along with the cross wise extending tees, defines the interconnecting grid structure for subsequent installation of ceiling tiles. According to the conventional art, two (2') and four (4') foot spaced cross tees (and corresponding 2'×2' or 2'×4' tiles) are employed in assembling and completing the grid structure.

As is also known in the relevant art, room measurements rarely, if ever, even out to provide equidistant dimensions established between opposite and parallel extending border locations of the grid structure and upon the installer taking such measurements in the conventional fashion or through use of the underlying marking scheme provided by the main grid runners. In either event, the installer is required to undertake additional measurement and sectioning of the main runners (through the use of a tape measure typically) to achieve the desired and equidistant border dimensions and before installing the main runners.

It is also conventionally known that an equidistant distance to be achieved for each of two opposite border locations will either fall into a dimension of less than 48" (four feet) or 24" (two feet), based again on whether 2'×2' or 2'×4' tiles (see again at 28 in FIG. 1) are to be utilized. The main runner indicia scheme provides the installer, once he or she has previously determined the overall required length of the room enclosure and the required dimension for establishing the equidistant and opposite extend borders, with the ability to immediately proceed with sectioning an exact portion from the end of the main runner, utilizing the imprinted indicia scheme.

The measurement indicia scheme according to the present invention includes a plurality of half inch incremental markings extending from the exposed end 108 of the main runner 18" to a location six inches inwardly. The extending measurement indicia is divided into ½ markings which iterate at locations 110 (at ½" from exposed end 108), 112 (at 1"), 114 (at 1½"), 116 (at 2"), 118 (at 2½"), 120 (at 3" and corresponding to location of initial elongated channel 32"), 122 (at 3½"), 124, (at 4"), 126 (at 4½"), 128 (at 5"), 130 (at 5½) and, finally at 132 (at 6" measured inwardly from the exposed end 108).

The first three (3") elongated channel 32" is located, naturally, at the midpoint of the six (6") inch indicia scheme and is considered to function as a primary reference point (see reference line 134) for determining a desired sectioning distance. The next succeeding and elongated channel is located in actuality a distance of nine (9") inches from the end location 108 of the main runner 18", however it is, for present purposes, considered only to be a secondary reference point (see reference line 136) of an additional six (6") beyond the primary reference point 134 (or first elongated channel 32").

As has been previously stated, all succeeding/intermediate extending channels (beyond initial for first elongated channel (32 or 32") of the main tees (e.g. as additionally illustrated at 36, 38, et. seq. in FIGS. 2–4) are at identical and six (6") increments, such that a desired subset group of these elongated channels iterate (in inches) as follows: three inches (32); six inches (34)—also understood to be a total of nine inches from the exposed end of the main tee but considered only as being six inches relative to first channel 32; twelve inches (36); eighteen inches (38); twenty-four inches (66 see again FIGS. 3 and 4); thirty inches (68); thirty-six inches (70); forty-two inches (72) and forty-eight inches (by example again at 74 in FIGS. 3 and 4).

As has again been previously explained, and for purposes of measuring and establishing the equidistant border layout, reference is not necessarily made to the six inch markers beyond 48" (such as at fifty-four inches (76), sixty inches (78) since this range will fall into areas designated for placement of full sized tiles and beyond the maximum of four feet (48") designated for subsection into the border area.

As again previously explained, the measurement indicia scheme of the present invention takes advantage of the fact that only plus or minus variations of six inch increments need to be considered when determining where to section the main runner and prior to equidistant placement of the border extending cross runners. Considering the six (6") incremental factoring, the border measurement scheme accordingly only requires immediate consideration of the primary reference point 134 (first elongated channel 32"), the next succeeding six inch spaced and secondary reference point 136 (also second elongated channel 34"), and the 0–6" measurement indicia scheme 110–132. By example, the desire to establish a thirteen (13") inch border at each end of the assembled main runner(s) requires only the installer to proceed to the primary reference point 134 (considered again to equate to 6", 12", 18", etc., distances), beyond which the installer counts out an additional one (1") inch (to marking 116) and towards the exposed end 108 of the main tee 18".

According to a further example, and by which the installer desires to establish a seventeen (17") inch border, the installer will then desirously select the secondary reference point 136 (rather than the primary reference point 134) due to the fact that an additional five (5") is desired beyond the selected six inch increment to which each of the primary and secondary reference points equates. In the second example a selected twelve (12") inch increment is associated with the secondary reference point 136 and further due to the fact that only three (3") inches exist beyond the primary reference point 134 and the exposed end 108 of the main runner 18". In order to quickly complete the measurement, and subsequent sectioning act, the installer designates the second reference point 136 as equating twelve (12") inches, then adds five (5") additional inches in a direction towards the primary reference point 134. This calculation immediately resulting in the installer jumping to the primary reference point 134 (six inches away) and counting back one (1") inch (to marking 124) towards the secondary reference point 136, at which point the runner 18" is sectioned at the specified location and the resulting and overall running length of the main runner, or plurality of interconnected main runners, is such that an equidistant 17" is provided at each opposite end of the assembled main tee and due to the resulting array of elongated channels arrived at after sectioning.

An additional feature of the invention is the provision of a dot, or other suitable marking 137 (see again FIG. 6). The marking is repeated in the middle of every 6" iteration along the main runner 18" (only one of which is illustrated), and with the exception of the initial border indicia. The purpose of the centered markings 137 is to enable the user to establish an equal and opposite end of a main runner when sectioning for installation in specified room enclosures. Specifically, the centered markings cooperate with the 6" spaced elongated channels to enable the user to better visually estimate where to section the main runner and based upon specified room measurements. Such markings can also be applied to wall angle (not shown) for the same purpose.

The border measurement and indicia scheme of the invention may also advantageously utilizes the marking system incorporated into the main runners for the identification and proper location of the cross runners prior to engagement of the connector clips within the main runner channels. Specifically, the color coding variation of the underlying marking system can be utilized by the installer in quickly establishing reference points (typically within the 24" or 48" ranges of each opposite main tee end) and, optionally, for counting back to the primary and/or secondary reference points and border indicia scheme. Also, and assuming further that a sectioned end of the main runner 18" is desired to abut against an associating wall angle (such as previously recited at 19') the connector clip 106 may only (in rare instances) itself may be sectioned off to establish a clean and exposed end (108). More typically, the requirement of measuring forwardly or rearwardly from the primary reference point 134 (or forwardly only from the secondary reference point 136) will result in both the connector clip 106 and some end portion of main tee 18" being sectioned and once the installer has instantaneously arrived at the desired border length.

Referring further to FIGS. 1 and 5 in combination, a diagonal ruler marking 138 (see reduced length cutaway in FIG. 6) is provided for the purpose of measuring the diagonal distances of a standard 2×4 grid section, at the beginning of installation, and to ensure standard and equal distance. It has been determined that, for standard 15/16" width grid that a marking 138 at 53⅜" inches along the main runner is desirable. A further marking 140 (at a slightly smaller distance) is intended to correspond to diagonal measurement of a grid utilizing 9/16" wide grid, it being understood however that 15/16" wide grid is the industry standard and being accounted for by dot marking 142. Referring also again to FIG. 1, diagonal measurements, between intersecting runners 12', 12" and 18 and 20, are indicated at 144 and 146 in phantom.

Accordingly, the present invention discloses a novel and useful border measurement scheme for enabling the installer to almost instantaneously arrive at a correct, and typically opposite/equidistant, border dimension for an engaging cross. Additional preferred applications will become apparent to those skilled in the art to which it pertains and without deviating from the scope of the appended claims. Specifically, the extent of the border indicia scheme, while extending six inches from the end location, can be modified to other extending lengths, which may result from offsetting location and placement of the elongated channels along the main tees.

I claim:

1. A border measurement system for use with a suspended grid structure, and for establishing a specified distance between a wall angle and a plurality of engageable cross runners, said system comprising:

at least one main runner defining, in cross section, a tile support lip and a web extending from said support lip, a plurality of elongated channels being formed through first and second opposite faces of said web at axially spaced apart intervals and between a first end and a second end;

the plurality of cross runners extending between first and second selected main runners, each of the cross runners also defining, in cross section, a tile support lip and a web extending in substantially perpendicular fashion from a midpoint of said support lip, first and second connector clips extending from associated first and second ends of each of the cross runners and engaging, in laterally inserting fashion, through aligning channels defined in said first and second selected main runners, and a measurement indicia scheme being applied to at least one exposed end border portion of each of said main runners and extending inwardly from said at least one exposed end border portion a limited distance, which is less than an overall length of each of said main runners, said indicia scheme including equally spaced and incremental markings coinciding with the placement and location of at least a first of said elongated channels positioned relative said main runner end, said indicia scheme further establishing a defined distance from a second and succeeding elongated channel, said first and second elongated channels corresponding, respectively, to primary and secondary reference points proximate said extending end of said main runner, said primary reference point being located a first measured distance from said main runner end, said secondary reference point being located at a succeeding and greater measured distance from said primary reference point, said measurement scheme being employed, upon selection of one of said primary and secondary reference points, to establish a correct border distance of said main runners for sectioning and prior to location of said cross runners and engagement of said connector clips within said main runner channels and so that equal borders are established along opposite extending ends of a room enclosure within which the grid structure is installed.

2. The border measurement system as described in claim 1, said measurement indicia scheme extending from each of opposite first and second ends of each of said main runners.

3. The border measurement system as described in claim 1, said primary reference point being located at a distance of three (3") inches from said end of said main runner.

4. The border measurement system as described in claim 3, said secondary reference point being located at a succeeding distance of six (6") inches from said primary reference point.

5. The border measurement system as described in claim 4, said measurement indicia being applied at selected one half (½") inch increments from said main runner end, a three inch indicia marking corresponding to said primary reference point.

6. The border measurement system as described in claim 5, said measurement indicia scheme extending a total of six (6") inches from said main runner end and terminating an exact distance of three (3") inches short of said secondary reference point.

7. The border measurement as described in claim 1, further comprising a marking indicia applied to selected channels of said main runners and in a desired and alternating fashion.

8. The border measurement system as described in claim 7, said marking indicia further comprising coding selected channels according to at least one color indicia.

9. The border measurement system as described in claim 8, further comprising first, second, third and fourth selected color indicias corresponding to selected and alternating channels.

10. The border measurement system as described in claim 1, each of said connector clips further comprising an outwardly flared tab portion, said tab portions abutting against an associated side edge of said elongated channel and preventing inadvertent disengagement of said cross runner from said interengaged main runner.

11. The border measurement system as described in claim 1, said main runners further comprising apertures formed through each of said main runner webs, hanger wires extending from a ceiling and looping through selected ones of said apertures to suspend said main runners from the ceiling.

12. A measurement indicia scheme, applied to a main runner of a suspended grid structure, to establish a correct border distance of the main runner and between an associated wall angle and interconnecting cross runners, comprising:

the main runner defining, in cross section, a tile support lip and a web extending from said support lip, a plurality of elongated channels being formed through first and second opposite faces of said web at axially spaced apart intervals and between a first end and a second end;

said measurement indicia scheme being applied to at least one exposed end border portion of said main runner and extending inwardly from said at least one exposed end border portion a limited distance, which is less than an overall length of said main runner, said indicia scheme including equally spaced and incremental markings coinciding with the placement and location of at least a first of said elongated channels positioned relative said main runner end, said indicia scheme further establishing a defined distance from a second and succeeding elongated channel, said first and second elongated channels corresponding, respectively, to primary and secondary reference points proximate said extending end of the main runner, said primary reference point being located at a first measured distance from said main runner end, said secondary reference point being located at a succeeding and greater measured distance from said primary reference point, said measurement scheme being employed, upon selection of one of said primary and secondary reference points, to establish a correct border distance of the main runner for sectioning and prior to location of the cross runners and engagement of connector clips, associated with the cross runners, within the main runner channels and so that equal borders are established along opposite extending ends of a room enclosure within which the grid structure is installed.

13. The measurement indicia scheme as described in claim 12, said scheme extending from each of opposite first and second ends of each of said main runners.

14. The measurement indicia scheme as described in claim 12, said primary reference point being located at a distance of three (3") inches from said end of said main runner.

15. The measurement indicia scheme as described in claim 14, said secondary reference point being located at a succeeding distance of six (6") inches from said primary reference point.

16. The measurement indicia scheme as described in claim 15, said measurement indicia being applied at selected one half (½") inch increments from said main runner end, a three inch indicia marking corresponding to said primary reference point.

17. The measurement indicia as described in claim 16, said measurement indicia scheme extending a total of six (6") inches from said main runner end and terminating an exact distance of three (341 ) inches short of said secondary reference point.

18. The measurement indicia scheme as described in claim 12, further comprising a diagonal ruler marking, established at a selected distance along said main runner, for ensuring equidistant diagonal measurements of a 2'×4' grid section.

19. The measurement indicia scheme as described in claim 12, further comprising additional markings at centered and iterative locations along the main runner, and between succeeding elongated channels, said markings permitting visual estimation and sectioning of the runner to accommodate a given grid dimension.

* * * * *